United States Patent [19]

James

[11] 4,206,523

[45] Jun. 10, 1980

[54] APPARATUS FOR LIFTING DISABLED PERSONS

[75] Inventor: David R. James, Hasfield, England

[73] Assignee: Mecanaids Limited, Gloucester, England

[21] Appl. No.: 934,793

[22] Filed: Aug. 17, 1978

Related U.S. Application Data

[63] Continuation of Ser. No. 738,594, Nov. 3, 1976, abandoned.

[30] Foreign Application Priority Data

Nov. 28, 1975 [GB] United Kingdom ..... 48916/75

[51] Int. Cl.[2] ..... A47K 3/12; A47K 3/062

[52] U.S. Cl. ..... 4/562

[58] Field of Search ..... 4/185 L, 185 R, 134; 248/124, 226 R, 415; 5/81 R, 81 B, 86

[56] References Cited

U.S. PATENT DOCUMENTS

| | | | |
|---|---|---|---|
| 1,892,274 | 12/1932 | Herschen | 4/185 L |
| 2,664,142 | 12/1953 | Scheuerman et al. | 4/185 L |
| 2,813,277 | 11/1953 | Zillt | 4/185 L |
| 3,371,357 | 3/1968 | Berthelsen et al. | 4/185 L X |
| 3,815,163 | 6/1974 | Sullivan | 4/185 L |
| 3,829,916 | 8/1974 | James | 4/185 L X |
| 3,879,770 | 4/1975 | Grant | 4/185 L |
| 3,918,108 | 11/1975 | Feyerherm | 4/185 L |

*Primary Examiner*—Henry K. Artis

*Attorney, Agent, or Firm*—Cushman, Darby & Cushman

[57] ABSTRACT

A bath lift, for lifting a disabled person into and out of a bath, has a telescopic column for mounting on the floor alongside the bath. A lifting arm mounted on the top of the column projects therefrom and carries a support, such as a legless chair structure, for the person being bathed. An upper portion of the column is non-rotatable about the axis of the column, and the arm is mounted to swing about a vertical axis. Locking means are operative to lock the arm against swinging movement relative to said upper portion of the column in one or more angular positions, and the locking means can be released manually to free the arm for movement about said vertical axis.

11 Claims, 4 Drawing Figures

APPARATUS FOR LIFTING DISABLED PERSONS

This is a continuation, of application Ser. No. 738,594 filed Nov. 3, 1976 and now abandoned.

FIELD OF THE INVENTION

This invention relates to apparatus for lifting invalids or other persons who are disabled or infirm. It is particularly concerned with so-called "bath lifts" which are mounted on or adjacent a bath and operative to lift a person into and out of the bath for bathing purposes while supported in a sitting or reclining position.

BACKGROUND OF THE INVENTION

A bath lift normally has a column which in use is fixed to the floor alongside the bath, or in some cases to the side of the bath itself, a lifting arm which projects from the column and elevating mechanism by which the arm can be raised and lowered. The end of the arm remote from the column carries a patient support member which may, for example, be in the form of a legless chair. The arm swings through an arc so that, in addition to being raised and lowered above the bath, the user can be swung over the edge of the bath and also raised and lowered at the side of the bath.

It is usual to have the arm fixed to an upper portion of a telescopic column, which extends for lifting purposes with the upper portion freely rotatable about the column axis at all levels. There is thus the danger that as the user gets on to the support member the arm may swing round causing injury to the user by striking against the side of the bath, and this is particularly so when the lift is self-operated by a partially disabled user.

To overcome the above danger it has been proposed that said upper portion of the column to which the arm has been fixed should be restrained against rotation except when fully raised, in which position it is freely rotatable at least over an appropriate range of angular movement. This goes some way towards solving the problem, but it considerably complicates the telescopic column construction internally and it is often inconvenient not to be able to turn the arm except when fully raised. There are also occasions when it would be advantageous if the arm did not swing freely when fully raised.

SUMMARY OF THE INVENTION

According to the invention a bath lift comprises a telescopic column for mounting on or adjacent the bath with an upper portion providing a support for a lifting arm projecting from the column, said upper column portion being non-rotatable about the axis of the column and the arm mounted on said support so as to swing about a vertical axis, and locking means operative to lock the arm relatively to the support in a desired angular position and arranged for manual release to free the arm.

Thus on release of the locking means the arm can be swung about said vertical axis, which is preferably the column axis, at any height of the column. It can also be locked when the column is fully raised, and the use of the invention does not unduly complicate the internal column construction.

The arm may be selectively lockable to the arm support in a plurality of discrete angular positions, but the locking means may alternatively operate to clamp the arm to the support at any desired position within the available angle of rotation of the arm. The arm may be freely rotatable on the arm support when the locking means are disengaged, although in some cases it may be preferred for the range of angular movement of the arm relative to the support to be limited, for example to swing through 180°.

The arm may be selectively lockable in any one of a sufficient number of angular positions to allow for mounting of the column at alternative positions around the bath, for example either at the lefthand side or at the righthand side of the bath. For simplicity it is preferred that only two alternative lockable angular positions of the arm relatively to the column be available, in which case alternative mounting positions of the column may be accommodated by arranging that the non-rotatable upper column portion can be fixed in a selected one of a plurality of angular positions.

Means associated with the lower telescopic column portion may be provided for adjusting the height of the column as a whole and hence varying the mean height of the lifting range provided by the elevating mechanism which produces the normal telescopic height adjustment for the arm. These means may also be operative to locate the lower telescopic column portion in alternative angular positions whereby to provide corresponding alternative angular positions for the upper column portion.

The apparatus may be in accordance with our U.S. Pat. No. 3,829,916, with an arm cranked or curved in plan view as described in the specification of that patent. In a preferred embodiment utilising such an arm two alternative angular positions are provided in which the arm is selectively lockable, with the arm swinging through 140° between these positions, and two alternative angular positions of the column relative to a floor mounting plate are provided separated by 40°. This arrangement allows a choice of lefthand or righthand mounting positions for the column.

The locking means may comprise a spring-loaded detent, with a manually-operable detent member mounted on the arm for selective engagement with detent notches or recesses provided in the arm support and which define said discrete angular positions. Alternatively, in a clamping arrangement, an end boss of the arm which is mounted on the support may have a radial flange which abuts a radial flange on the support, both flanges being surrounded by a manually-releasable clamping ring.

Non-rotatability of the upper column portion is preferably achieved by fixing the lower column portion to a floor mounting plate and interconnecting the two column portions through relatively sliding non-circular telescopic means housed within the column and which prevent relative rotation of the two column portions about the column axis. The elevating mechanism preferably employs a screw jack with a screw coupled to a top winding handle mounted on said arm support and with the screw engaging a nut fixed to the lower column portion. With this arrangement relative rotation of the column portions may be prevented by mounting the nut at the upper end of a guide tube in which the lifting screw is received, this tube having a non-circular cross-section and engaging a bore of complementary shape in a bush fitted within the upper column portion and slidable along the tube.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
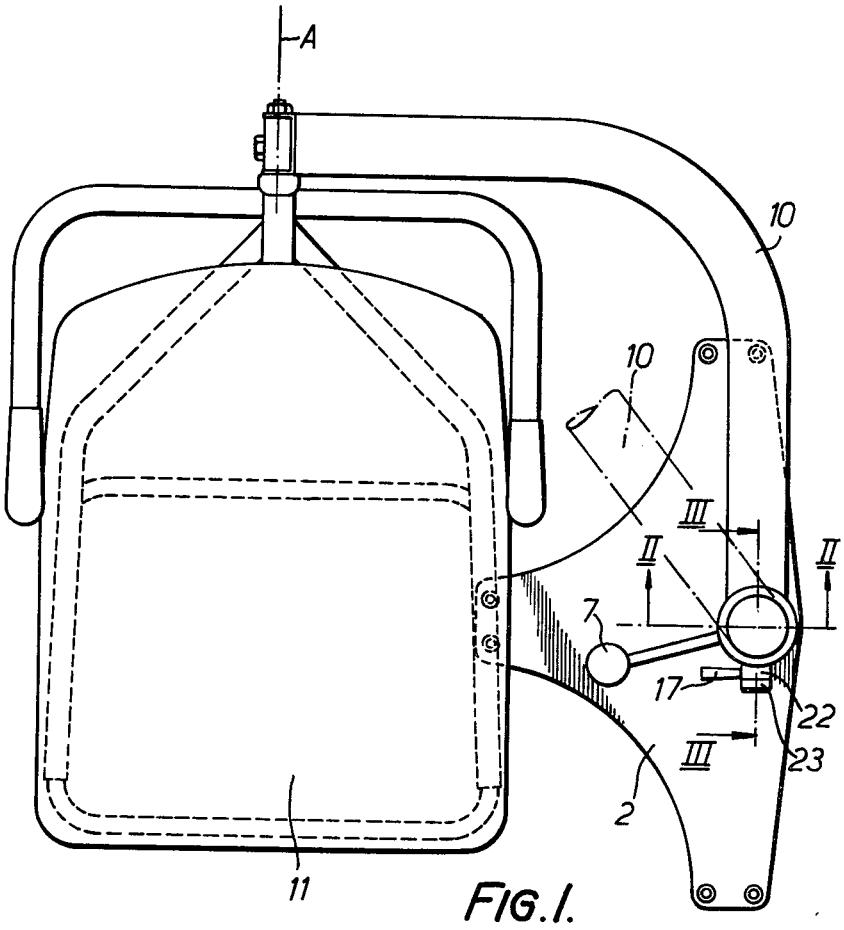
FIG. 1 is a plan view of a preferred embodiment of bath lift in accordance with the invention.
Figure 4:
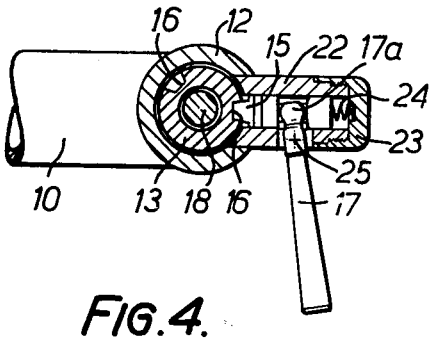
FIG. 4 is a fragmentary sectional view on the line IV—IV in FIG. 3.

A telescopic vertical lifting column 1 is fixed to a floor mounting plate 2 which is fitted to the floor, by mounting bolts such as 3, alongside a bath (not shown). The column 1 comprises a lower telescopic portion 4 and an upper telescopic portion 5, a screw jack 6 within the column being operated by a top winding handle 7 in order to raise or lower the portion 5 which is non-rotatably received in the portion 4. The lifting range can be adjusted in respect of its mean height position, and to this end the column portion 4 comprises an outer sleeve **4*a* fixed to the floor plate 2 to provide a socket and a tube 4*b* which is closely received in the sleeve 4*a* and within which the upper portion 5 telescopically slides. A spring-loaded detent 8 at the bottom end of the tube 4*b* is selectively engageable with a vertical series of locating bores 9 in the sleeve 4*a*. To allow for alternative mounting positions for the column 1, for example at either the lefthand or the righthand side of the bath, the vertical series of locating bores 9 shown in FIG. 2 is duplicated, with the two vertical series of bores separated by an angle of 40° about the column axis. The alternative arm position thus provided is shown in broken lines in FIG. 1**.

Figure 2:
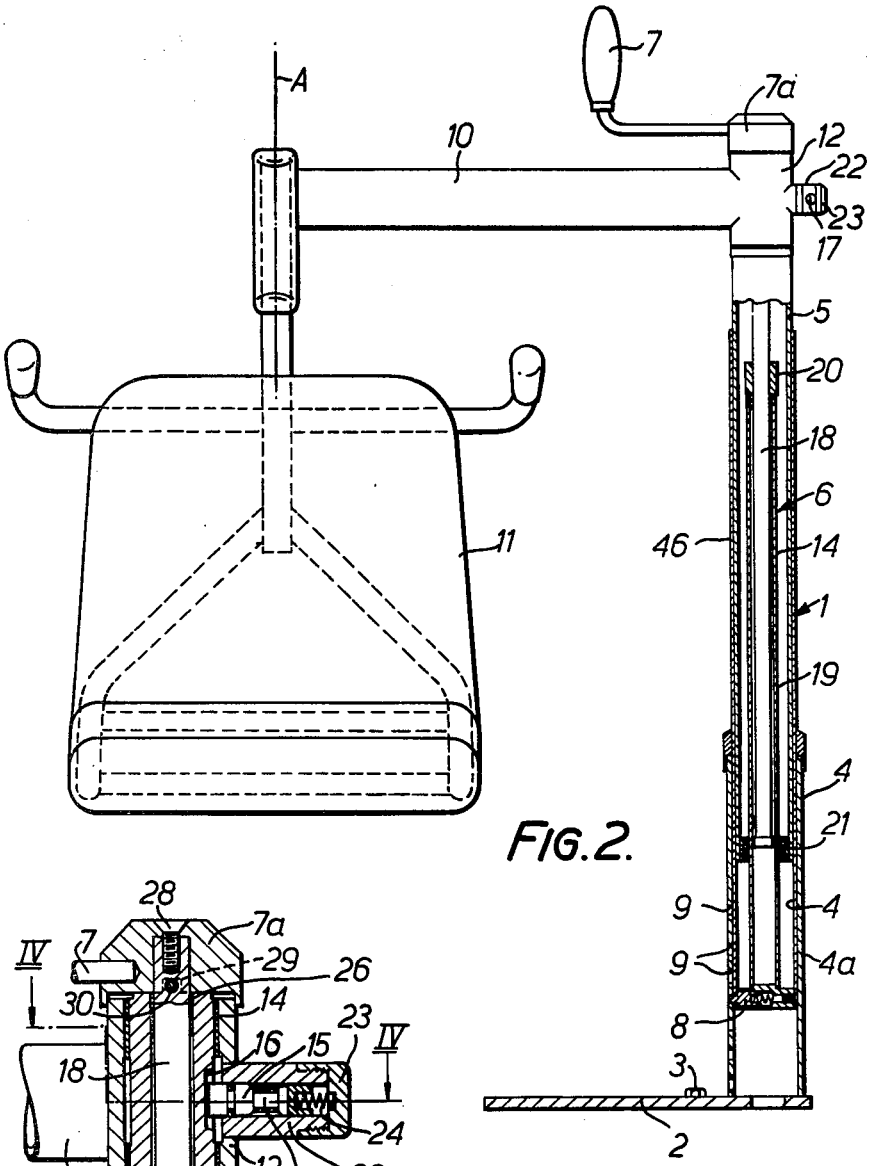
FIG. 2 is a front view with a lifting column shown partly in section on the line II—II in FIG. 1.
Figure 3:
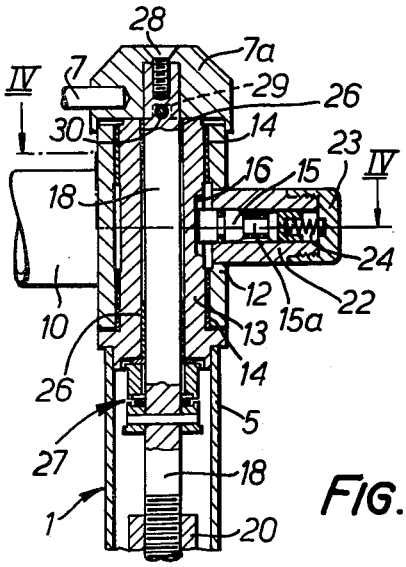
FIG. 3 is a fragmentary sectional view of the upper end of the column, on the same section line.

A lifting arm 10, which is bent through a right angle in plan view as shown in FIG. 1, projects from the column 1 and at its free end rigidly supports a rigid patient support seat 11 which is rotatable about a vertical axis A and cantilevered from the arm while depending therefrom. At the column end the arm 10 has a boss 12 by which it is rotatably supported on an arm support 13 which provides a journal bearing for the arm and is fixed to the upper end of the column portion 5. Bearing bushes 14 are fitted in the boss 12 and the arm can be swung, about the column axis, from a position above the bath to a position alongside the bath at which the user can be placed on and removed from the chair.

To prevent the arm 10 swinging inadvertently when insufficiently raised, with the danger of the user being injured by striking the side of the bath, the arm 10 is selectively lockable in either one of two discrete angular positions by a spring-loaded detent member 15 engageable selectively with either of two detent recesses 16 in the arm support 13. The detent member 15 has a reduced intermediate neck portion **15*a* and is slidable within a tubular housing 22 fixed into the boss 12. The housing 22 is closed by a screwed-on end cap 23 which provides a spring abutment for the detent spring 24. The detent member 15 can be displaced manually, to free the arm 10 for rotation on the support 13, by a short operating lever 17 which is pivotally mounted in a side aperture of the housing 22 about a pivot axis 25. The lever 17 has a forked inner end 17*a* which engages the neck portion 15*a* of the detent member 15, whereby manual pivotal movement of the lever 17 displaces the detent member 15 against the spring 24 to free the arm 10**.

Thus an arrangement is provided in which the arm 10 is normally locked in a chosen angular position, so that there is no danger of inadvertent or accidental angular displacement which might injure the user, yet the arm can be freed for rotation at any height position. Furthermore, the safety and simplicity of having only two alternative arm positions is achieved while allowing either lefthand or righthand mounting of the apparatus, due to the provision of alternative series of locating bores 9 in the sleeve **4*a*. However, in an alternative design which achieves the same result but is not illustrated, four recesses 16** are provided arranged in two respective pairs, the two positions of each pair being spaced 180° apart with the two pairs mutually displaced by 40°. It will be appreciated that the number of lockable alternative angular positions for the arm on the arm support, and the number of angular positions of the column available, can be chosen according to requirements.

In accordance with the invention the upper column portion 5 is non-rotatable about the column axis and this feature can be achieved in a variety of ways, for example by manufacturing the column from telescopic tubes of non-circular section. In the illustrated embodiment the non-rotatability of the column portion 5 is achieved without sacrificing the manufacturing and other advantages of using circular section telescopic tubes, the means restraining the portion 5 against rotation being associated with the central screw jack 6.

The jack 6 comprises a central screw 18 fixed at its upper end to a boss **7*a* of the handle 7. The boss 7*a* is fixed to the end of the jack screw 18 by a fixing screw 28 and it has diametrically opposite bottom recesses 29 which respectively engage the ends of a cross pin 30 to couple the handle 7 to the screw 18. The screw is received in a central vertical guide tube 19 within the column and fixed at its bottom end to the outer telescopic tube 4*b*, and the nut 20 of the screw jack is fixed at the top of the tube 19. The tube 19 is of hexagonal section and passes through a bush 21 having a complementary bore and which is fixed in the lower end of the column portion 5, thereby restraining the latter against rotation. The screw 18 turns in bearings 26 within the arm support 13, and a friction brake 27 of known form is arranged between the screw 18 and the support 13 below the latter. This brake is automatically freed when the handle 7** is turned, and on release of the handle automatically engages to prevent any danger of free fall of the arm under gravity.

It will be appreciated that the floor mounting arrangement described can readily be replaced by a bath mounting which clamps or otherwise attaches to the side of the bath itself.

I claim:

1. A bath lift comprising a mount positioned on or proximate a bath, a telescopic column having a lower portion fixed to said mount and an upper portion vertically movable with respect to said lower portion, said upper portion being normally rotatably fixed with respect to said lower portion of said column, means for moving said upper portion of said column vertically with respect to said lower portion, arm support means fixed to said upper portion of said column, a lifting arm projecting from said column and mounted on said arm support, said lifting arm being swingable about a vertical axis relative to said support means, and means connected between said lifting arm and said upper portion of said column for locking said lifting arm in a selected angular position, said locking means being manually releasable to free said lifting arm for rotational movement on said support means about said vertical axis.

2. A bath lift according to claim 1, wherein said vertical axis coincides with the longitudinal axis of said column.

3. A bath lift according to claim 1, wherein said lifting arm is selectively lockable in a plurality of discrete angular positions.

4. A bath lift according to claim 1, wherein said locking means includes means for clamping said lifting arm to said arm support means at a selected position within a predetermined angular range of rotation of said lifting arm.

5. A bath lift according to claim 1, wherein said telescopic column is mounted at the left hand or the right hand side of said bath.

6. A bath lift according to claim 5, wherein said vertical axis coincides with the longitudinal axis of said telescopic column and said lifting arm is selectively lockable in either of two angular positions, said upper portion of said telescopic column being fixed in a selected one of a plurality of angular postions.

7. A bath lift of claim 6, wherein said upper and lower portions of said telescopic column each having a circular cross-section and wherein relative rotation between said upper and lower portions is prevented by a sliding non-circular telescopic means positioned within said column and interconnecting the upper and lower portions thereof.

8. A bath lift according to claim 1, wherein said means for locking comprises means for adjusting the height of said telescopic column at discrete intervals and for positioning said upper portion of said column in alternative angular positions relative to said mount.

9. A bath lift according to claim 8, wherein said lower portion of said column comprises a sleeve fixed to said mount and a tube received in said sleeve, said upper portion of said column being telescopically received in said tube, and wherein said means for vertically adjusting said column comprises vertically spaced bores in said sleeve, said bores being selectively engageable by a spring loaded plunger mounted in and projecting from said lower portion of said column, and a plurality of vertically spaced bores.

10. A bath lift according to claim 1, wherein said means for locking said lifting arm comprises a detent housing mounted on a boss at the end of said lifting arm, a spring loaded detent member radially movable in said housing with respect to said boss for engaging said arm support, and a lever projecting from the side of said detent housing, said lever being pivotally mounted with respect to said housing and having an inner end portion which engages said detent member.

11. A bath lift comprising;

a mount positioned on or proximate a bath, a telescopic column having a lower portion fixed to said mount and an upper portion vertically movable with respect to said lower portion, said upper portion being normally rotatably fixed with respect to said lower portion of said column, means for permitting rotation of said upper portion with respect to said mount in either of two angular postions separated by approximately 40° about the axis of said column, means for moving said upper portion of said column vertically with respect to said lower portion, arm support means fixed to said upper portion of said column, a lifting arm projecting from said column and mounted on said arm support, said lifting arm being swingable about a vertical axis relative to said support means through approximately in 140° range, and means connected between said lifting arm and said upper portion of said column for locking said lifting arm in a selected angular position, said locking means being manually releasable to free said lifting arm for swinging movement on said support means about said vertical axis.

* * * * *